US007249764B2

(12) United States Patent
Donovan

(10) Patent No.: US 7,249,764 B2
(45) Date of Patent: Jul. 31, 2007

(54) BOARD GAME

(75) Inventor: Don R. Donovan, Sebastopol, CA (US)

(73) Assignee: Sevinpold Castles, Inc., Eugene, OR (US)

( * ) Notice: Subject to any disclaimer, the term of this patent is extended or adjusted under 35 U.S.C. 154(b) by 56 days.

(21) Appl. No.: 11/157,752

(22) Filed: Jun. 21, 2005

(65) Prior Publication Data

US 2006/0284377 A1 Dec. 21, 2006

(51) Int. Cl.
*A63F 3/00* (2006.01)

(52) U.S. Cl. ..... 273/254; 273/262

(58) Field of Classification Search ..... 273/255, 273/262, 254

See application file for complete search history.

(56) References Cited

U.S. PATENT DOCUMENTS 6,575,463 B1 * 6/2003 Wintersteen ..... 273/261

6,964,417 B2 * 11/2005 Bodish ..... 273/289

* cited by examiner

*Primary Examiner*—Vishu K. Mendiratta
(74) *Attorney, Agent, or Firm*—Dergosits & Noah LLP

(57) ABSTRACT

The board game is set up so that a group of people each control a single game figure and play against a single person who controls a group of game figures. The game board includes a number of castle spaces which each have a treasure card. This treasure card is revealed when a figure lands on the castle space. All players move across the board trying to obtain the scepter treasure card which is hidden at one of the castle spaces and determine the location of the living throne located at another castle space. If one of the individually controlled figures finds the scepter, that specific figure must bring the scepter to the living throne castle space in order to win the game. If one of the group of figures controlled by one player obtains the scepter treasure card, any one of the group of figures just get to the living throne castle space in order to win the game.

20 Claims, 2 Drawing Sheets

BOARD GAME

FIELD OF THE INVENTION

This invention is related to board game that uses playing pieces, dice and playing cards.

BACKGROUND OF THE INVENTION

Many board games have been developed which have specific rules and allow multiple players to compete against each other. These games frequently have imaginary themes such as knights that must defend kingdoms and defeat the enemy. A problem with many of these games is that when one player gains a strong position midway through the game, it is then difficult or impossible for this player in a strong position to be defeated (Examples: In the game Risk™—whoever gets the most clues first, wins; in a game Monopoly™—once a player possesses Boardwalk, Park Place and several other key properties, it is then a matter of time before he or she wins). This leads to boring interaction for the remainder of the game. If this type of one sided play occurs frequently, the game will generally not be interesting and will tend to sit on a shelf.

What is needed is a game that does not play out the same way twice, requires skill like chess but also has elements of chance like Risk™. The game should is not be easy to master right away, but is easy to start playing and enjoying right from the first play. The game should also allow the possibility of a come from behind victory on the last movement or the last throw of the dice, no matter how far behind the player is.

SUMMARY OF THE INVENTION

The inventive board game simulates a power struggle in the fictional world of Sevinpold between the valiant figures and the darkness figures. Rather than all players completing against each other or teams having equal numbers of players, the inventive game is set up so that one player must fight against several other players. The one player controls the darkness figures and all other players are valiant figures who fight against the darkness. The object of the game is to find the hidden scepter treasure card and bring it to the castle that has the living throne treasure card.

The set of treasure cards includes: 1 "scepter" card, 1 "living throne" card, 10 "darkness" cards, 5 "use now" cards, and 15 "Treasures of Power" cards and the set of castle cards includes one castle card for each castle space on the board. The game includes a board, a set of castle cards, a set of treasure cards, dice, valiant pieces, darkness pieces, castle pieces and dice. The board is divided into a two dimensional grid of spaces. The center of the board is an area called "dark lightning" which is the starting point for the darkness figures. There are also 32 spaces that evenly distributed on the game board that are designed as "castle spaces."

The game is set up by designating a player to be the darkness and then having the remaining players each randomly pick a castle card and a treasure card. Each castle card corresponds to a castle space on the board. The castle card that is selected by the valiant player is the starting point for his or her valiant piece. If a darkness card is selected by a valiant player, an additional darkness piece is placed in the dark lightening area of the board. A castle piece, a castle card and a face down treasure card are placed on all castle spaces of the board that were not picked by a valiant player. When all of the valiant players have selected their castle and treasure cards and all the darkness figures have been placed in the dark lightening area the game can begin.

Each valiant player rolls the dice and moves their valiant figure across the board based upon the numbers on the two dice. The player can move the piece from the starting space in a vertical or horizontal direction but not diagonally. The player can move the piece the number of spaces that corresponds to the number on the first dice, the number on the second dice or the difference between the first dice and the second dice to a second space. If the player made the first move based upon the first or second number, the valiant piece can be moved again in a vertical or horizontal direction but not diagonally to a third space by the number of spaces on the unused dice. After the valiant players have moved, the darkness player can roll the dice and move each of the darkness pieces in the manner described above.

Each player moves their pieces across the board to the different castles to uncover the treasure cards. In addition to moving the figures by rolling the dice, some of the treasure cards include movement enhancements which alter the way that the figures can move. These special powers will be described in more detail later.

When a player lands on a castle, the hidden treasure card is revealed. If the treasure card is a "Darkness" card another darkness figure is placed in the dark lightening area. If the treasure card is a "Use Now" card, it must be used during that players turn. A "Treasures of Power" card can be used at any time during the game during the players turn. If the treasure card is "Living Throne" card, it is turned face up to indicate its location. If the treasure card is the "Scepter" card, it is kept with the figure unless the figure is captured by another figure after leaving the castle. The capturing of figures will be discussed later.

Each castle space also includes a castle piece. If the player lands on the castle space through dice rolling alone, the player acquires the castle piece. These castle pieces can be used later by the player to get to other castle spaces. If the player moves close to a castle, he or she can use each acquired castle piece to move an additional space so long as the player has enough castle pieces to land on castle space. If a treasure card or a castle piece is used to get to a castle space, the player does not acquire the castle piece.

The game also allows the valiant figures to capture darkness figures and visa versa. Figures can be captured by landing on the same board space or alternatively, by using a treasure card. When a Valiant captures a Darkness figure, the Darkness figure is removed from the game and the Valiant seizes any one treasure card. If there is only one Darkness figure left, this figure cannot be captured. When the Darkness figure captures a Valiant figure, the Valiant figure is removed until his or her next turn and the Darkness figures gets all of the treasure cards held by the Valiant. When the Valiant restarts the game, it is placed on an unvisited castle space and gets the corresponding treasure card.

As discussed, the object of the game for the valiants is to bring the scepter to the living throne. Thus, if a valiant or the darkness has the scepter, it should avoid being captured by the darkness.

BRIEF DESCRIPTION OF THE DRAWINGS

The invention is herein described, by way of example only, with reference to embodiment of the present invention illustrated in the accompanying drawings, wherein.

DETAILED DESCRIPTION

Figure 1:
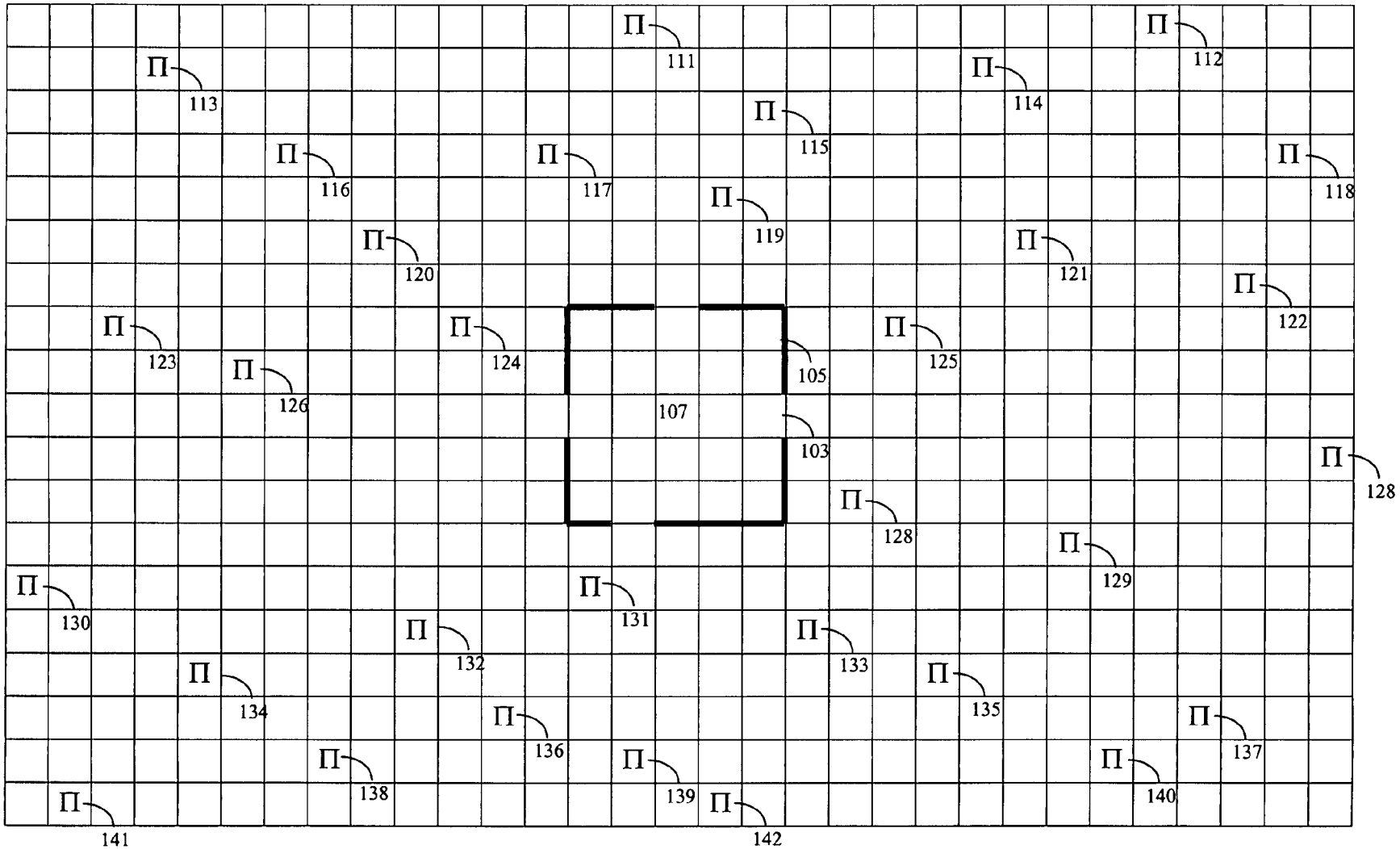
FIG. 1 is a top view of the game components.

With reference to FIG. 1, the inventive board game includes the following components: a deck of 32 Castle Cards, a deck of 32 Treasure Cards, 6 Valiant Figurines, 10 Darkness Figurines, 1 Living Throne Figurine, 32 Castle Pieces, 2 Pairs of Dice (one white, one black) and 1 Game Board. The game is suitable for 2-6 players and is set up with on Darkness player against a team of all other Valiant players. The object is for either a Valiant Player or The Darkness Player to possesses "The Scepter" Treasure Card and land on the castle with "The Living Throne" in order to win the game.

The teams are selected by choosing one player to be "The Darkness." Ideally, this should be the most experienced player. If the players cannot agree, then each player should take turns picking treasure cards from the deck. The first player to pick one of "The Darkness" treasure cards will be the Darkness. All remaining players are Valiants and play as a team against the Darkness.

Before playing the game, the cards, pieces and castles are set up in a specific manner. The treasure deck of cards and the castle deck of cards are shuffled thoroughly and both decks are placed face down. Each Valiant player picks 1 castle card and 1 treasure card and places them face up. The castle card has a specific name that refers to a specific space on the game board. With reference to FIG. 1, the game board With reference to FIG. 1, each Valiant player then places his or her Valiant figurine on the board 101 on the castle space that corresponds to the castle card that was picked. Each remaining castle on the board should be covered with a castle piece. At this point, every castle on the board 101 should be covered either with a Valiant figurine or a castle piece. If a Valiant player picks one of "The Darkness" treasure cards during the set-up phase of the game, the Darkness player will place one of the Darkness figurines at Dark Lightning area 107 of the board 101. In the preferred embodiment, the Dark Lighting area 107 is located in the center of the board 101. Four black walls 105 surround the Dark Lightning area 107 and there is a gate 103 in each of the surrounding walls 105. The inventive game is played by moving the figurines across the board 101 however the Valiant pieces are never allowed to pass through the walls 105 or gates 103 surrounding the Dark Lightning area 107. When Darkness figurines are released into the game, they are only permitted to pass through the four gates 103 and they are not allowed to move over the black walls 105 that surround the Dark Lightning area 107. Based upon the set up procedures, the game can start with 1-10 Darkness figurines at the Dark Lightning area 107.

If, during the set-up phase, either "The Scepter" or "The Living Throne" treasure card is picked by a player, it must be returned to the pile and another treasure card must be selected. The game should not begin with either the Scepter or the Living Throne treasure cards revealed. After the players have picked their castle and treasure cards, the remaining treasure cards are individually placed face down so that no one can see what they are. One castle card is placed face up on top of each treasure card so that all of the remaining Treasures are associated with each of the remaining castle spaces on the board but hidden from view. Each of the castle spaces is given a name.

Once the game set up is complete, the game can be played. The players take turns rolling the dice and moving their game pieces. The Valiant players will each start first from their own castles and the darkness will start last from the Dark Lightning area. The Valiant Player to the left of The Darkness Player will go first by rolling the dice and moving as described above. For each successive turn, the player to the left will roll next. The Darkness player always goes last. The players continue to move their figures across the board until they land on a castle board space or land on another player's piece.

The game is played by moving the game pieces towards the castle game spaces to reveal the treasure cards or moving the game pieces towards other game pieces to capture the other piece. When the player's game piece lands on a castle space, the treasure card is acquired and placed face up so that all other players, including The Darkness player, can see it.

In an embodiment, the board may be a rectangular grid of 31 spaces by 19 spaces that includes 31 castles spaces distributed on the grid. In other embodiments, the board any be any number of grid spaces arranged in any geometric shape. Each of the castle spaces on the game board is given a name. Exemplary names and locations for the castle spaces are listed in Table 1 below.

TABLE 1

| Castle Name | Reference # in FIG. 1 |
|---|---|
| Bridge To Other Realms | 111 |
| Storm Turrets | 112 |
| Footprints of the Behemoth | 113 |
| Unknown Rune | 114 |
| Dungeon at Delharm | 115 |
| Whispers | 116 |
| Shadowed Stair | 117 |
| Moonquake | 118 |
| Mines of Mystery | 119 |
| Obelisk | 120 |
| Lightning Caverns | 121 |
| Lost Ships | 122 |
| Strategy | 123 |
| Teeth Towers | 124 |
| Stone Tree | 125 |
| Fortress of Flames | 126 |
| The Last Lighthouse | 127 |
| The Maze of Gotholomir | 128 |
| The Granite Signpost | 129 |
| Red Sands | 130 |
| Vaulted Arch | 131 |
| Eye of the Galaxy | 132 |
| Vale of Lore | 133 |
| Torchlight | 134 |
| Rooks | 135 |
| Triple Spires | 136 |
| Sapphire Tower | 137 |
| Phantoms | 138 |
| Petrahedron | 139 |
| Pools of Legend | 140 |
| Eclipse Stone | 141 |
| Battlements | 142 |

The players move their pieces across the board by rolling the two dice. Each dice is a six sided cube with each side numbered sequentially from 1 to 6. During each player's turn, the two dice are rolled, unless instructed otherwise by a Treasure Card.

Figure 2:
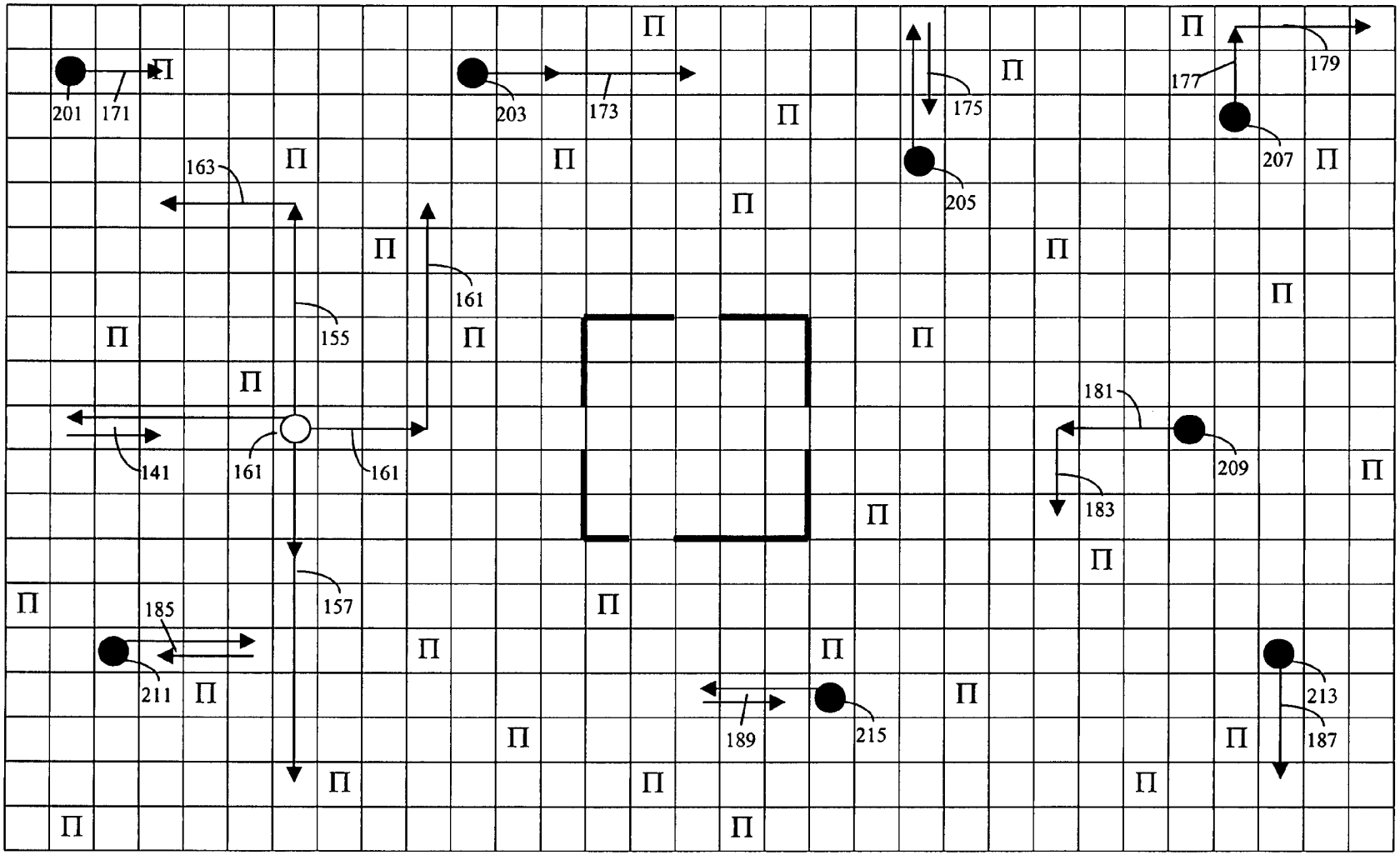
FIG. 2 is a diagram of the game figure movement.

With reference to FIG. 2, a unique aspect of the inventive game is the manner in which the game pieces are moved based upon the dice rolls. As illustrated in FIG. 1, the board 101 is a two dimensional grid of spaces. The valiant pieces can generally only move in the North, South, East or West directions across the board grid. The pieces cannot move diagonally across the board grid unless the player has a special "Sextant" treasure card which will be described later. The Valiant players can move the value of either single die, the value of both dice or the difference in their values. For Example, if a Valiant player rolls a 3 on one dice and a 5 on the second dice, the player can move the figure from a first space 151 in any of the following ways:

a) 3 consecutive spaces in any direction 153 (one die); or
b) 5 consecutive spaces in any direction 155 (one die); or
c) 8 consecutive spaces in any direction 157 (both dice); or
d) 2 consecutive spaces in any direction 159 (the difference: 5−3=2); or
e) 3 consecutive spaces in one direction 153 and 5 consecutive spaces in another direction 161; or
f) 5 consecutive spaces in one direction 155 and 3 consecutive spaces in another direction 163.

Based upon these special dice movements, rolling doubles is not very helpful because it limits the player's movement options. Rolling doubles does allow a player to stay in the same board space if desired, e.g., 3−3=0. The Valiant figures must move on every turn unless movement is forbidden by a treasure card.

The Darkness player also rolls the dice to move the Darkness figures in the manner described above. However, rather than moving a single figure like the Valiant, all darkness figures are moved based upon a single roll of the dice. The Darkness player rolls both dice on every turn, unless instructed otherwise by a treasure card. He or she must move each of the Darkness figurines in play either the value of one die, the value of both dice or the difference in their values. The Darkness figurines are each moved individually as long as these movements comply with the instructions above. For example, if there are 8 Darkness figurines on the board and the Darkness player rolls a 2 and a 3, the pieces may be moved as specified below:

a) Darkness #1, 201: Move 2 consecutive spaces in any direction 171 (one die);
b) Darkness #2, 203: Move 5 consecutive spaces in any direction 173 (both die);
c) Darkness #3, 205: Move 1 space in any direction 175 (3-2=1);
d) Darkness #4, 207: Move 2 consecutive spaces in one direction 177 and 3 consecutive spaces in another direction 179;
e) Darkness #5, 209: Move 3 consecutive spaces in one direction 181 and 2 consecutive spaces in another direction 183;
f) Darkness #6, 211: Move 1 space in any direction 185;
g) Darkness #7, 213: Move 3 consecutive spaces in any direction 187 (one die);
h) Darkness #8, 215: Move 3 consecutive spaces in one direction and 2 consecutive spaces in the opposite direction 189.

When any player lands on a castle space that has a face down treasure card, the card is turned face up. The treasure card deck includes: Scepter, Living Throne, Darkness, Use Now and Treasures of Power cards. In an embodiment, there may be 1 Scepter card, 1 Living Throne card, 10 Darkness cards, 5 Use Now cards and 15 Treasures of Power cards.

The goal of the game is to obtain the Scepter treasure card and take it to the castle containing the Living Throne. Every player is searching for the Scepter card. Once the Scepter is found, the player who possesses it must take it to the castle with the "Living Throne" in order to win the game. The opposing player or players must try to capture the Scepter and take it to the castle with the Living Throne.

Once the Living Throne treasure card is revealed, the Living Throne Figurine is placed on the castle space, marking the spot where the Scepter must be taken. The Living Throne Treasure Card is then placed in a discard pile and is not reused during the remainder of the game. Because the treasure cards are revealed in a random order as the players enter each of the castles, there is an equal probability that the Living Throne will be revealed before the Scepter is obtained.

There are some special rules regarding how a player may win the game. If the player who possesses The Scepter treasure card lands on a castle that contains the hidden Living Throne treasure card, this player cannot declare victory during this turn. Because the Living Throne is revealed for the first time when the player holding the Scepter lands on this castle, the player must wait until a subsequent turn to leave the castle and then re-enter while still possessing the Scepter.

There are various other treasure cards that can help or hinder the players in their quest. For example the "The Darkness" treasure card help the Darkness player but hinder the Valiant players. When a The Darkness treasure card is picked, a new Darkness figurine is released from the Dark Lightning area of the board. As discussed, the Dark Lightning area is typically located at the center of the board. There can be anywhere from 0-10 Darkness Figurines on the Board at any time throughout the game. Conversely, it is undesirable for a valiant player to draw a Darkness treasure card.

There are five "Use Now!" treasure cards that are helpful to both the Darkness and the Valiant. The use now cards include: the Mask, the Hourglass To Turn Back Time, Go To The Dungeon At Delharm, Poison and the Magic Ring. These five Use Now cards must be used during the turn in progress and cannot be used on subsequent turns. Once these Use Now treasure cards are played, they must be discarded.

The Mask treasure card allows a player to steal any one treasure card from any one player. The stolen treasure card cannot be used until a subsequent turn of the taking player.

The Hourglass To Turn Back Time allows the player to choose any discarded treasure card and return it to the game by placing it with any visited castle card, selected from the discarded castle cards. This "turns back time" by restoring a previously destroyed or used treasure, only this time all players know what the treasure card is and where it is located.

The Go To The Dungeon At Delharm card allows the player to send any one player or all of the emerged darkness figurines to the Dungeon at Delharm which is a specific castle space on the game board. The player sent to the Dungeon at Delharm castle is held prisoner at the location for one turn unless, during their turn, they roll a 7 or doubles. If a 7 or doubles isn't rolled, they must wait for their next turn to leave the dungeon. If they roll a 7 or doubles, they can leave the castle and proceed with their turn. If there is a treasure card available, the prisoner(s) can only claim it if he or she rolls doubles and leaves the castle by X spaces and re-enter to claim the Treasure by going the other X spaces back. Otherwise, the prisoner is not allowed to claim the treasure card.

The holder of the poison card is entitled to force any player or all of the emerged Darkness figurines to forfeit his/their next turn. The Magic Ring card allows the player to be immediately transported from the castle containing the treasure card to two other unvisited castles. The player claims the treasure cards of both castles and is transported to the second castle.

There are fifteen "Treasures of Power" Cards: the Horse, the Sextant, the Map, the Sleeping Spell, the Crown, the Guide, the Measure Of Strength, the Sudden Midnight, the Wings Of An Eagle, the Sword, the Longbow, the Dragon's Fire, the Wizard's Hat, the Revelation and the Seeing Stone. In contrast to the Use Now treasure cards, the Treasures of Power cards are to be used only one time as part of a turn of the player holding the card at anytime during the game.

Nine of the fifteen Treasures of Power cards, are used to enhance the movement of the game pieces across the board. The player holding the Horse card may move twice the roll of either die or both dice. For example, if the player rolls a 4 and a 6, the player can move 8 spaces, 12 spaces or 20 spaces.

A player can use the Sextant card may move diagonally the face value of one or both dice. This can be much more efficient if the desired destination is in a diagonal direction. For example, the diagonal movement of 5 spaces north west is equivalent to moving 5 spaces east and then 4 spaces north.

The holder of the Map card is entitled to move the number of spaces rolled from his location and continue off the game board to the corresponding space on the exact opposite side of the board. The Map card effectively converts the board so that the opposite sides are wrapped around to meet each other. For example, the players piece may move from Top to Bottom; Bottom to Top; Left Side to Right Side or Right Side to Left Side. The holder of the Sleeping Spell card takes two turns in a row. The Sleeping Spell effectively forces all other players to sleep for one turn. This card should be used at the end of a turn and allows the player to take an additional turn.

The Crown card has some special rules that are different than using the other cards. In order to use this card, the player must first announce that the Crown card will be used before rolling the dice and also announce which other players must obey the command. The player then rolls the dice and forces the chosen player or all of the Darkness Figurines to make any legal move allowed by the roll of the dice. The holder then moves his own figurine or darkness figurines using the same roll.

With the Guide card, instead of rolling the dice, the holder of this card moves five spaces in any direction and in any combination. If The Darkness is the holder of the guide card, every member of The Darkness can move five spaces in any direction in any combination. The holder cannot move his piece diagonally unless this card is used in combination with a Sextant card. For example, the holder can move one space North, two East, and then two North again for a total of five spaces. The Guide card can also be combined with the Horse card enabling the player to move twice the roll or ten spaces in any direction.

The Measure of Strength card allows the player to move one extra space in any direction, including diagonally, in addition to the regular dice roll. This can be useful when a castle or an opposing player having desirable treasure cards is only one space away from the players rolled board position.

The holder of the Sudden Midnight card forces every player to roll and move with only one die for the next round of turns. On his turn, the holder must first play this Treasure Card, then roll and move as usual. When all the other players take their next turn and roll, they will only be allowed to move with one die. Normal play resumes after one complete round like this. In effect, the players are temporarily blinded by the impact of Sudden Midnight and proceed more slowly than usual while the holder of the card moves freely.

The holder of the Wings Of An Eagle card may "fly" to any unvisited castle from any space on the board instead of rolling the dice. If the darkness obtains this card, All of The Darkness Figurines may fly to any unvisited castles instead of rolling the dice. The Wings Of An Eagle card does not allow the player to fly to any castle that has been visited. For example, if the player holds the Scepter, the player cannot use the Wings Of An Eagle card to fly to the castle that is known to contain the Living Throne.

If a player's movement by one of more of the Treasure Cards places the player on any unvisited Castle, the player gets the Treasure Card that is revealed. If a player's movement by one of more of the Treasure Cards places the player on another player, the moving player captures that player.

In addition to capturing players through movement by rolling the dice and treasure cards, there are three capture specific treasure cards: the Sword, the Longbow and the Dragon's Fire cards. If a player holds the Sword card, he or she may move first and then play the Sword card to capture any other player or players who are located one space away in any direction, including diagonally. The capture takes place without moving the piece to the location or locations of the captured pieces.

If the player holds the Longbow card, he or she can first move and then play the Longbow card to capture any player or players who are located up to two spaces away in any non-diagonal direction. The player may not capture any other player located in a diagonal direction even if the player has Sextant. Like the Sword, the holder of the Longbow may capture other pieces without moving to the location or locations of the captured pieces.

The holder of the Dragon's Fire card may destroy (take and discard) one Treasure of any other player that is within one space in any direction, including diagonally. The Treasure is captured but not the player. The player holding the captured treasure remains in on the board space. If a Valiant player is using the Dragon's Fire card, only one Treasure Card is taken from the Darkness player, regardless of the total number of Darkness Figurines in the one space radius region. However, if the Dragon's Fire card is used by the Darkness player, each Darkness Figurine can take a Treasure Card from every Valiant Player that is within one space in any direction, including diagonally, of every Darkness Figurines in play.

The deck of treasure cards also includes other "specific use" treasure cards. The Wizard's Hat card allows the holder to use the "power" of any one Treasure Card held by any other player. The Wizard's Hat card assumes the power of the other player's treasure card. This treasure Card which remains with the other player. After being used, the Wizard's Hat card is discarded.

Instead of rolling the dice, the holder of the Revelation card is entitled to choose any unvisited castle and take the corresponding treasure card without moving the game piece to the castle. The user of the Revelation card also has the option of "destroying" the treasure card by removing it from the game. The destroy option is useful when the player using the Revelation card is a Valiant and the treasure card revealed is a Darkness card. In this situation, the Darkness card is destroyed by permanently removing it from the game. This destroy option cannot be used when the treasure card revealed is the Scepter or the Living Throne card. If the Living Throne is revealed with the Revelation card, the Living Throne Figurine must be placed on the castle space. If the Scepter card is revealed, the player obtains the Scepter.

The Seeing Stone card allows the player to choose any unvisited castles and look at the Treasure Cards of these castles. If the Seeing Stone card is used, the player does not roll the dice or move in any way during a turn. The player may only find out what treasure cards are at each unvisited castles and is also not entitled to keep any of the revealed treasure cards. The player selects the castles and reveals each of the treasure cards one at a time until one of the Darkness treasure cards is uncovered and releases a Darkness Figurine at Dark Lightning. If all of the Darkness treasure cards have previously been revealed, then the turn ends once the holder of this card has seen all of the hidden treasure cards. The Valiant players are allowed to share this information with other Valiants.

Although the treasure cards are typically used one at a time, it is also possible for the Valiant and Darkness Players to use more than one treasure card on the same turn. For example, if a 5 and 2 are rolled, the player may move diagonally with the Sextant treasure card and then use the Sword treasure card to capture one space in every direction.

When any one of the Darkness Figurines uses a treasure card, it can no longer be used by any other Darkness Figurine, except as provided by the treasure cards, i.e., the Guide and the Wings of an Eagle treasure cards.

The 15 "Treasures of Power" Cards and the 5 "Use Now!" Cards are generally only used once. After the Treasures of Power and the Use Now cards have been played they must be placed in a discard pile. The only exception occurs when all treasure cards have been revealed but no one has won the game. In this situation, some of the treasure cards may be reused.

In addition to revealing the Treasure Card, the player that lands on the castle gets the castle piece. The castle piece can be used later to move one additional space to enter a castle. For example, if a player rolls in such as way as to land one space from the castle, a castle piece may be used to move one additional space to get to the castle space and receive the treasure card. If the player uses the castle piece to get to the castle space, the player will not receive the castle piece. Similarly, if the player uses a treasure card to get to the castle space, the player will not receive the castle piece. Only if the player lands on the castle space through the roll of the dice will the player receive the castle piece. Players can also use multiple Castle Pieces to gain entry to a castle if the player has the number of Castle Pieces corresponding to the number of spaces separating the Valiant Figurine from the castle. For example, if a player is 3 spaces away from a castle, he or she can use 3 Castle Pieces to gain entry to the castle. If the player only has 2 Castle Pieces, these cannot be used to gain entry to the castle. The castle pieces cannot be used to capture another piece or move to any space on the board other than a castle space. Once used to gain entry, the castle pieces are removed from the game.

In addition to storming the castles, the treasure cards can also be acquired by capturing other pieces. To capture another piece, players must land on exactly the same space as the other player that they are capturing or use a capture specific treasure card. Players cannot be captured while on a castle space. When a Valiant figure captures a Darkness figure, the Darkness piece is removed from the game and the Valiant can seize any one Treasure Card from The Darkness player. However, if The Darkness has only one piece on the Board, this piece is invincible and cannot be captured. Also, the Darkness Figurines cannot be captured inside the walls surrounding the Dark Lightning.

When The Darkness captures a Valiant, the Valiant is removed from the game until his/her next turn and the Darkness takes all of the treasure cards held by the Valiant figure. At the beginning of the next turn after being captured, the Valiant must select an unvisited Castle of his/her choice to start from. The Valiant then takes the treasure card found at that Castle and rolls the dice to begin the quest again.

In order for the Valiants to declare a victory, the Valiant figurine who has the Scepter must land on the castle where the Living Throne is located. For the Darkness to win, any one of the Darkness figurines must land on the castle where the Living Throne is located while any one of the Darkness figurines has the Scepter. Normally, winning the game is fairly straightforward, however there are some special rules for winning the game under special circumstances.

If a Darkness figure captures a Valiant who possesses the Scepter and another Darkness figure is in the castle containing the Living Throne, the Darkness cannot win until the next turn. The Darkness figure must leave and return to the castle with the Living Throne. If the Darkness player rolls doubles, the player wins the game by moving X spaces out of the castle and X spaces back into the castle. If doubles are not rolled on that turn, he or she must leave the castle according to the roll. The player cannot win until, he or she rolls a number that allows that player to move back into the Living Throne castle while still possessing the Scepter.

A Valiant or Darkness player who possesses the Scepter cannot win until he or she lands on the castle where the Living Throne has already been revealed. If the Valiant or any Darkness Figurine possesses the Scepter and lands on a castle where the Living Throne treasure card is, for the first time revealed, he or she cannot win on that same turn. The Living Throne piece must be placed on the castle and the player must wait until the next turn to win. The player must still possess the Scepter and leave the castle by landing on a space outside the castle before returning to the castle to win the game.

In an embodiment, it may be necessary to include various additional rules that keep the game play fair. If a Valiant player uncovers either the Scepter or the Living Throne at a time when there are no Darkness figurines in the game, regular play is suspended while the Darkness player looks under castle cards in search of a The Darkness treasure card. When he finds this card, he will place a Darkness figurine at Dark Lightning, roll the dice and begin play again. The Darkness player is also entitled to keep any treasure cards he or she uncovers during this search.

A "No Continuation" rule may require a player's turn to end when he or she lands on a square as determined by the roll of the dice or treasure card. The players cannot land on a castle, find a treasure and then use another treasure card to move onward. The players cannot capture another player with the movement of the dice or a Treasure Card and then "continue on" using another part of the dice roll, unless a Use Now! treasure card permits the player to take action after entering a castle. For example, the Magic Ring treasure card permits the player to go to two unvisited castles in a row immediately after finding it.

When the last unvisited castle has been entered and the last remaining Treasure revealed, but the player with the Scepter" has not entered the castle with the Living Throne, then some of the treasure cards can be reused. In one embodiment, five of the discarded treasure cards can be re-used and hidden again in order to keep the game in play. These cards can be randomly selected from the discarded treasure cards, shuffled placed face down individually. Five of the Castle Cards can also be randomly selected and placed over each of the five treasure cards. This process can be repeated as many times as necessary for someone to win the game.

The inventive game has many advantages over most prior art board games. The game is a combination of chance and skill. It is estimated that the factors required to win the game are about 70% skill and about 30% chance based upon the rolling of the dice and the luck in drawing treasure cards. The inventive game also has the advantage of never playing the same way twice. The game requires a substantial amount of time to master through play but the game is easily learned and can be played by a novice right away. There is always a chance that a player will be able to win even at the last roll of the dice when the situation looks hopeless. This possibility of a come from behind victory adds excitement to the inventive board game that is lacking in many prior art board games when one player starts to dominate the game.

How the game is played is completely unique. The game is played between the Darkness, a single player, controlling multiple figures and the Valiant, several players each controlling one board figure. The Valiants players must play as a team against a single Darkness player to have a possibility of winning. The movement of the pieces across the board wherein a player can move with 1 die, 2 dice, or the difference between the two dice may also be unique.

While the present invention has been described in terms of a preferred embodiment above, those skilled in the art will readily appreciate that numerous modifications, substitutions and additions may be made to the disclosed embodiment without departing from the spirit and scope of the present invention. For example, the board layout, the names of the castles, the names of the treasure cards and their special features can be changed or modified while still remaining within the spirit and scope of the game. It is intended that all such modifications, substitutions and additions fall within the scope of the present invention that is best defined by the claims below.

What is claimed is:

1. A method of playing a board game, comprising:

(a) providing: a game board having a plurality of spaces arranged in a two dimensional grid wherein some of the spaces are castle spaces and at least one of the spaces is a dark lightning space, a pair of dice; a plurality of valiant figures each controlled by different valiant players, a plurality of darkness figures all controlled by one darkness player and a set of treasure cards that include: darkness cards, a scepter card and a living throne card;

(b) randomly associating one of the treasure cards with each of the castle spaces face down so the valiant players and darkness player do not know which of the treasure cards are associated with the castle spaces;

(c) placing each of the valiant figures on the castle spaces and placing one of the plurality of darkness figures on the dark lightning space;

(d) rolling the pair of dice for one of the valiant figures;

(e) moving the valiant figure on the game board grid horizontally or vertically a number of spaces corresponding to the first dice on the game board and optionally moving the valiant figure horizontally or vertically a number of spaces corresponding to the second dice on the game board;

(f) if the valiant figure lands on one of the castle spaces on the game board that has one of the face down treasure cards, disclosing the treasure card, if the disclosed treasure card is one of the darkness cards, placing one of the darkness figures not on the board in the dark lightning space, if the disclosed treasure card is the scepter, associating the scepter with the valiant figure and if the disclosed treasure card is the living throne, designating the castle space as the living throne castle;

(g) repeating steps d-f until each of the valiant figures has moved;

(h) rolling the pair of dice for the darkness figures;

(i) moving each of the darkness figures horizontally or vertically by a number of spaces associated with the first dice on the game board and optionally moving each of the darkness figures horizontally or vertically a number of spaces associated with the second dice on the game board;

(j) if any of the darkness figures lands on one of the castle spaces on the game board, disclosing the treasure card associated with the castle space, if the disclosed treasure card is one of the darkness cards, placing one of the darkness figures not on the board in the dark lightning space, if the disclosed treasure card is the scepter card the corresponding darkness figure obtains the scepter and if the disclosed treasure card is the living throne card the castle space becomes the living throne;

(k) repeating steps d through k; and (l) winning the board game for the valiant figures if one of the valiant figures picks up the scepter treasure card and moves to the living throne castle space or winning the board game for the darkness figures if one of the darkness figures pick up the scepter treasure card and any of the darkness figures moves to the living throne castle space.

2. The method of playing the board game of claim 1 further comprising the step:

capturing the scepter treasure card by moving to the space occupied by the valiant figure or the darkness figure that has the scepter treasure card, wherein if the valiant figure captures the darkness figure, removing the darkness figure from the board and if the darkness figure captures the valiant figure, moving the valiant figure to one of the castle spaces on the board.

3. The method of playing the board game of claim 1 further comprising the steps:

providing a plurality of castle pieces which are placed on the castle spaces, wherein the castle piece is picked up if the valiant figure or the darkness figure moves to the castle space using only the movement from the rolling the dice step.

4. The method of playing the board game of claim 3 further comprising the steps:

after step (f) if the valiant figure is within one space of one of the castle spaces and uses one of the castle pieces, moving the valiant figure to the castle space.

5. The method of playing the board game of claim 1 further comprising the steps:

providing a "sextant" treasure card in step (a) that allows the player to move diagonally; and during step (e) if the valiant figure uses the "sextant" treasure card, moving the valiant figure in a diagonal direction across the board by a number of spaces associated with the numbers determined by step (d).

6. The method of playing the board game of claim 1, further comprising:

providing a "mask" treasure card in step (a) that allows the player to take one treasure card held by one of the players.

7. The method of playing the board game of claim 1, further comprising:

providing a "wings of an eagle" treasure card in step (a) that allows the player to move the valiant figure to any of the castle spaces that have not been visited; and using the "wings of an eagle" treasure card to move to one of the castle spaces that has not been visited instead of steps (c) and (d).

8. The method of playing the board game of claim 1, further comprising:

providing a "horse" treasure card in step (a) that allows the valiant player to move twice; and using the "horse" treasure card to repeat steps (c) and (d).

9. The method of playing the board game of claim 1, further comprising the step:

after step (e) capturing one of the darkness figures if the valiant figure moves to a space occupied by the darkness figure, wherein if the valiant figure captures the darkness figure, the valiant figure takes one of the treasure cards held by the darkness player and removes the darkness figure from the board; and after step (i) capturing one of the valiant figures if the darkness figure moves to a space occupied by the valiant figure, wherein if the darkness figure captures the valiant figure, the darkness figure takes all of the treasure cards held by the valiant player controlling the valiant figure.

10. The method of playing the board game of claim 9, wherein if the valiant figure is captured by the darkness figure, the valiant figure is moved to one of the castle spaces.

11. A method for playing a board game comprising the steps:

(a) providing a board having a plurality of spaces arranged in a two dimensional grid wherein some non-adjacent spaces on the grid are castle spaces and at least one of the spaces is a darkness starting space;

a die having multiple surface marked with different numbers;

a plurality of valiant figures that are distinct in appearance, wherein each of the plurality of valiant pieces is controlled by a different player, a plurality of darkness figures that are all controlled by one of the players;

a set of treasure cards that include: darkness cards, a scepter card and a living throne card wherein each of the treasure cards is associated with a different castle space and the treasure cards information is not disclosed to the players;

(b) placing the valiant figures on the castle spaces wherein each of the valiant figures occupies a different one of the castle spaces and placing one of the darkness figures on the darkness starting space;

(c) rolling the die for one of the valiant figures;

(d) moving one of the valiant figure horizontally or vertically by a number of spaces associated with the die;

(e) disclosing the treasure card associated with the castle space if the valiant figure lands on one of the castle space, placing one of the plurality of darkness figures on the darkness starting space if the disclosed treasure card is one of the darkness cards, designating the castle space as the living throne if the disclosed treasure card is the living throne card and associating the scepter with the valiant figure if the disclosed treasure card is the scepter card;

(f) repeating steps (c) through (e) for each of the valiant figures;

(g) rolling the dice for one or more of the darkness figures;

(h) moving each of the plurality of darkness figures on the board horizontally or vertically by a number of spaces associated with the die;

(i) disclosing the treasure card associated with the castle space if any of the darkness figures lands on one of the castle space, placing one of the plurality of darkness figures on the darkness starting space if the disclosed treasure card is one of the darkness cards, designating the castle space as the living throne if the disclosed treasure card is the living throne card and associating the scepter with the darkness figures if the disclosed treasure card is the scepter card;

(j) repeating steps (c) through (i); and (k) winning the board game for the valiant figures if the valiant figure with the scepter treasure moves to the living throne castle space or winning the board game for the darkness figures if one of the darkness figures obtains the scepter treasure card and any of the plurality of darkness figures moves to the living throne castle space.

12. The method for playing the board game of claim 11 further comprising the steps:

capturing the scepter for the darkness figures if one of the darkness figures moves to a space occupied by a valiant figure that has the scepter, the darkness figures obtain the scepter;

capturing the scepter for the valiant figures if one of the valiant figures moves to a space occupied by a darkness figure that has the scepter, the valiant figure obtains the scepter.

13. The method for playing the board game of claim 11 further comprising:

providing a plurality of castle pieces that that are each placed on the castle spaces on the board wherein if the valiant figure lands on the castle space, the valiant figure obtains the castle piece and during step (d) the valiant figure may use castle piece to move one additional space to move to one of the castle spaces and wherein if one of the darkness figures lands on the castle space, the player controlling the darkness figures obtains the castle piece and during step (h) one of the darkness figures may use castle piece to move one additional space to move to one of the castle spaces.

14. The method for playing the board game of claim 11 wherein the plurality of movement treasure cards include cards that allow the valiant figures to move in a manner other than step c or allow the darkness figures to move in a manner other than step g.

15. The method for playing the board game of claim 11 wherein the treasure cards include a "wings of an eagle" treasure card that allows the valiant figure to move to one of the castle spaces during step (d) or allow all of the darkness figures to move to the castles space.

16. The method for playing the board game of claim 11 wherein step (a) includes providing a "sextant" treasure card that allows one of the valiant figure to move diagonally during step (d) or all of the darkness figures to move diagonally during step (h).

17. The method for playing the board game of claim 11 further comprising the steps:

capturing the valiant figure if one of the darkness figures moves to a space occupied by the valiant figure wherein the captured valiant figure is temporarily removed from the board for one round of movement;

capturing the darkness figures if one of the valiant figures moves to a space occupied by the darkness figure wherein the captured darkness figure is removed from the board until a darkness card is disclosed.

18. The method for playing the board game of claim 11 wherein the treasure cards include a "dragon's fire" card that allows the player to take and discard one of the treasure cards held by one of the valiant figures or the darkness figures.

19. The method for playing the board game of claim 11 wherein the treasure cards include a "revelation" treasure card that allows the valiant figure or the darkness figures to take the treasure card from one of the castle spaces without moving to the castle space.

20. The method for playing the board game of claim 11 wherein the treasure cards include a "seeing stone" treasure card that allows the valiant figure or the darkness figure to look at the treasure card associated with one of the castle spaces without moving to the castle space.

* * * * *